US005578987A

United States Patent [19]

XuYang et al.

[11] Patent Number: 5,578,987

[45] Date of Patent: Nov. 26, 1996

[54] MONITORING APPARATUS FOR AN ALARM DEVICE

[75] Inventors: Zhou XuYang; Koichi Futsuhara; Masayoshi Sakai, all of Saitama-ken, Japan

[73] Assignee: The Nippon Signal Co., Ltd., Tokyo, Japan

[21] Appl. No.: 569,161

[22] PCT Filed: Jun. 29, 1994

[86] PCT No.: PCT/JP94/01055

§ 371 Date: Dec. 21, 1995

§ 102(e) Date: Dec. 21, 1995

[87] PCT Pub. No.: WO96/00955

PCT Pub. Date: Jan. 11, 1996

[51] Int. Cl.[6] ..... G08B 29/00; H04R 29/00

[52] U.S. Cl. ..... 340/506; 340/507; 340/515; 340/533; 340/538; 340/661; 340/664; 340/635; 340/310.01; 340/825.06; 340/825.25; 381/58; 381/59

[58] Field of Search ..... 340/506, 507, 340/511, 512, 516, 531, 825.16, 532, 533, 538, 514, 515, 513, 657, 664, 661, 310.01, 635, 653, 692, 825.06, 825.25; 381/58, 59, 77; 367/197–199

[56] References Cited

U.S. PATENT DOCUMENTS

| | | | |
|---|---|---|---|
| 3,009,137 | 11/1961 | Cassell | 340/514 |
| 3,487,397 | 12/1969 | Kaplan et al. | 340/514 |
| 3,656,158 | 4/1972 | Goodwater | 340/507 |
| 4,203,096 | 5/1980 | Farley et al. | 340/538 |
| 4,554,533 | 11/1985 | Bosnak | 340/514 |
| 4,661,880 | 4/1987 | Futsuhara | 361/93 |
| 4,667,184 | 5/1987 | Futsuhara | 340/507 |
| 5,027,114 | 6/1991 | Kawashima et al. | 340/941 |
| 5,164,703 | 11/1992 | Rickman | 340/515 |
| 5,361,305 | 11/1994 | Easley et al. | 381/58 |

FOREIGN PATENT DOCUMENTS

| | | |
|---|---|---|
| 63-315957 | 6/1990 | Japan . |
| 63-323902 | 6/1990 | Japan . |
| 64-317347 | 8/1991 | Japan . |
| 5-275686 | 5/1995 | Japan . |

*Primary Examiner*—Donnie L. Crosland
*Attorney, Agent, or Firm*—Wolf, Greenfield & Sacks, P.C.

[57] ABSTRACT

A monitoring apparatus for an alarm device for situations wherein the alarm device is provided at a location remote from the alarm device drive side, which can verify from the alarm device drive side if an audible alarm has sounded. The drive of the alarm device (1) is stopped by switching off a drive switch (12) on the alarm device drive side (A). After stopping the drive of the alarm device (1) an audible alarm generation sensed signal from the response device (2) on the alarm device side (B)is received at the alarm device drive side (A) though the feeder (a). Then, after the audible alarm generation sensed signal has stopped, and on receipt of a verification signal verifying that the alarm device drive side (B) has returned to the original condition, a verification output (F3) for the audible alarm generation is generated at the alarm device drive side (A).

8 Claims, 9 Drawing Sheets

MONITORING APPARATUS FOR AN ALARM DEVICE

TECHNICAL FIELD

The present invention relates to a monitoring apparatus for monitoring if an audible alarm for warning of danger has been generated by an alarm device. More particularly the present invention relates to audible alarm generation monitoring technology suitable for cases where an alarm device operates at a remote location.

BACKGROUND ART

In cases for example at a factory and the like where several mechanical moving parts are started simultaneously, then if a worker is doing maintenance on even one of these, there is an extreme danger to the worker. Therefore, in the production areas of such factories, alarm devices are located in the vicinity of each of the mechanical moving parts to thereby minimize danger to workers when several of the parts are started together. These alarm devices are simultaneously driven by a drive operation from a command post and the like which is remote from the alarm devices, immediately before starting the mechanical moving pads, so that an audible alarm is generated to warn the worker of the impending start-up.

When the place where the alarm device is driven is remote from the alarm device itself however, there is a possibility that the generation of the audible alarm cannot be verified from the alarm device drive side. This situation wherein the drive operation is executed at the alarm device drive side to generate the audible alarm and start the mechanical moving part, without verification that the audible alarm has been sounded, can be extremely dangerous to workers at the work site. From a worker safety point of view it is therefore important to first verify that the audible alarm has been generated at the site of the mechanical moving part, before mechanical startup. A monitoring apparatus which can verify from the drive side that such an audible alarm has been generated thus becomes highly desirable.

The present inventors have already proposed in Japanese unpublished Patent Application No 5-275686, a technology for monitoring the drive condition of an alarm device. This technology involves a construction wherein, when safe, a non audible frequency drive current is supplied to an audible alarm generator such as a speaker, while when there is danger, an audible frequency drive current is supplied. The drive current flow is continually monitored, and the alarm device conditions are judged to be normal when a drive current is flowing. With this system however, it is not possible to confirm that an alarm sound which can be heard by workers in the danger area has actually been generated.

In view of the abovementioned situation, it is an object of the present invention to provide a monitoring apparatus for an alarm device, which is located at an alarm device drive side remote from the alarm device, and which can verify that an audible alarm is actually generated when the alarm device is driven.

DISCLOSURE OF THE INVENTION

In accordance with the present invention, there is provided a monitoring apparatus for an alarm device, where an alarm device side is situated remotely from an alarm device drive side, for monitoring from the alarm device drive side, the generation of an audible alarm at the alarm device side, said alarm device side including; an alarm device for generating an audible alarm, and an audible alarm generation sensing device for sensing an audible alarm generated by said alarm device and transmitting an audible alarm sensed output to said alarm device drive side within a predetermined time interval after the audible alarm has stopped, said alarm device drive side including; a power source connected through a feeder to said alarm device and audible alarm generation sensing device on the alarm device side, a drive switch disposed in a command lead connected in parallel with said feeder connecting the power source and alarm device, which is switched on to apply a command signal for audible alarm generation to said alarm device, a first verification device for verifying the generation of an audible alarm based on an audible alarm sensed output from said audible alarm generation sensing device transmitted through said feeder after audible alarm generation of said alarm device is stopped by switching off said drive switch, a second verification device for verifying that the alarm device side has returned to an original condition the same as that prior to audible alarm generation, based on a current change in said feeder due to the stopping of the audible alarm sensed output of the audible alarm generation sensing device, and a judgment device for generating a normal judgment output indicating that an audible alarm has been generated normally, when a verification output of an audible alarm sensed output is generated in the first verification device, and a verification output of the return to the original condition is generated in the second verification device.

With such an apparatus in a situation wherein the alarm device drive side for driving the alarm device is remote from the alarm device side, the generation of an audible alarm can be verified from the alarm device drive side, so that audible alarm generation can be verified before starting a mechanical moving pad. Hence the safety of a worker working in the vicinity of the moving part can be improved. Furthermore, since the sensed output for audible alarm generation can be obtained using the feeder for supplying power from the alarm device drive side to the alarm device, then a separate wiring system for obtaining the sensed output for the audible alarm is not required.

The construction may be such that said audible alarm generation sensing device incorporates, an audio/electric converter for receiving an audible alarm from the alarm device and giving an electrical output corresponding thereto, an amplifier for amplifying the output from the audio/electric converter, a rectifier circuit for rectifying an output from the amplifier and provided with an off-delay function which delays a fall in the rectified output by a predetermined time, a switching circuit having a transistor with a collector connected through a current reducing resistor to said feeder, and an emitter connected to earth, and which comes on when an output from said rectifier circuit is applied to the base, allowing a current to flow in said current reducing resistor thus changing the current in said feeder.

With such an apparatus, the presence or absence of audible alarm generation is represented by a current change in the feeder and can be transmitted as such through the feeder to the alarm device drive side.

The construction may be such that said first verification device includes, a first current sensor which generates a high level verification output verifying audible alarm generation, only when a current is detected flowing in the feeder during the time a current is flowing in said current reducing resistor after switching off said drive switch, and an off-delay circuit which delays the fall in the output from the first current sensor by a predetermined time, said second verification device includes, a second current sensor which generates a high level verification output verifying that the alarm device side has returned to the original condition, only when a current is detected flowing in the feeder when the drive switch is switched off and there is no current flowing in said current reducing resistor, and said judgment device includes a self-holding circuit with the output of the off-delay circuit input as the trigger input, and the output of the second current sensor input as the reset input, for self-holding said trigger input.

More specifically, said first and second current sensors may incorporate respective cores made from a saturable magnetic material, each with four windings namely first through fourth windings wound therearound, and arranged such that the respective first windings are supplied with a high frequency signal from a signal generator, the respective second windings are connected in series with each other along said feeder, the respective third windings are connected in parallel with each other to said power source, and the sensor outputs are produced from the respective fourth windings, the construction being such that a current is supplied to the third winding of the first current sensor to cancel a magnetic flux produced in the core thereof when the feeder current during the time a current is flowing in said current reducing resistor after switching off the drive switch, flows in the second winding of the first current sensor; and a current is supplied to the third winding of the second current sensor to cancel the magnetic flux produced in the core thereof when the feeder current at the time of no current flow in said current reducing resistor with the drive switch switched off, flows in the second winding of the second current sensor.

With the first and second sensors constructed in this way, then in the event of a failure such as a winding disconnection, a high level output is not produced from the respective fourth windings, thus enabling the realization of a fail safe current sensor.

The first verification device may incorporate, an amplifier for amplifying a high frequency signal which is output from the fourth winding of the first current sensor, a rectifier circuit for rectifying the amplified output of the amplifier and clamping this at the power supply voltage, and a level checking circuit for generating a high level output when the output of the rectifier circuit is equal to or greater than a predetermined threshold value set higher than the power supply voltage, and may be constructed such that a fall in the output of said level checking circuit is delayed by a predetermined time by said off-delay circuit.

With such a construction, the first verification device, at the time of a fault, does not generate high level verification output verifying audible alarm generation.

The second verification device may have a construction incorporating; an amplifier for amplifying a high frequency signal output from the fourth winding of the second current sensor, a rectifier circuit for rectifying the amplified output of the amplifier and clamping this at the power supply voltage, a level checking circuit for generating a high level output when the output of the rectifier circuit is equal to or greater than a predetermined threshold value set higher than the power supply voltage, and an on-delay circuit which outputs the output of said level checking circuit after a predetermined time delay.

Hence, in a similar manner to the first verification device, the second verification device, at the time of a fault, does not generate a high level output indicating that the alarm device side has normally returned to the original condition.

Moreover, the construction may be such that when the second winding of the first current sensor and the second winding of the second current sensor are connected in series with each other along said feeder, a fail-safe type AND gate is provided which carries out a logical product operation on an output of the series circuit of the two second windings and an output of the judgement device, and generates no output at the time of a fault.

With each current sensor, when the second and third windings are simultaneously disconnected, the core cannot be saturated so that the high frequency signal from the first winding is transmitted directly to the fourth winding, resulting in a high level output being generated from the current sensor. By providing an AND gate such as mentioned above however, then in the final step the verification output for the audible alarm generation can be stopped, so that the fail-safe feature can be ensured.

The construction may be such that a plurality of alarm devices and a plurality of audible alarm generation sensing devices for respectively sensing the audible alarms of each alarm device are connected in parallel with each other to the feeder, and said plurality of alarm devices are also connected in parallel with each other to said command lead.

As a result, the plurality of alarm devices can be driven simultaneously through a single feeder, with it also being possible to transmit verification of audible alarm generation of the respective alarm devices back through the single feeder to the alarm device drive side.

BEST MODE FOR CARRYING OUT THE INVENTION

As follows is a detailed description of embodiments of the present invention with reference to the drawings.

Figure 1:
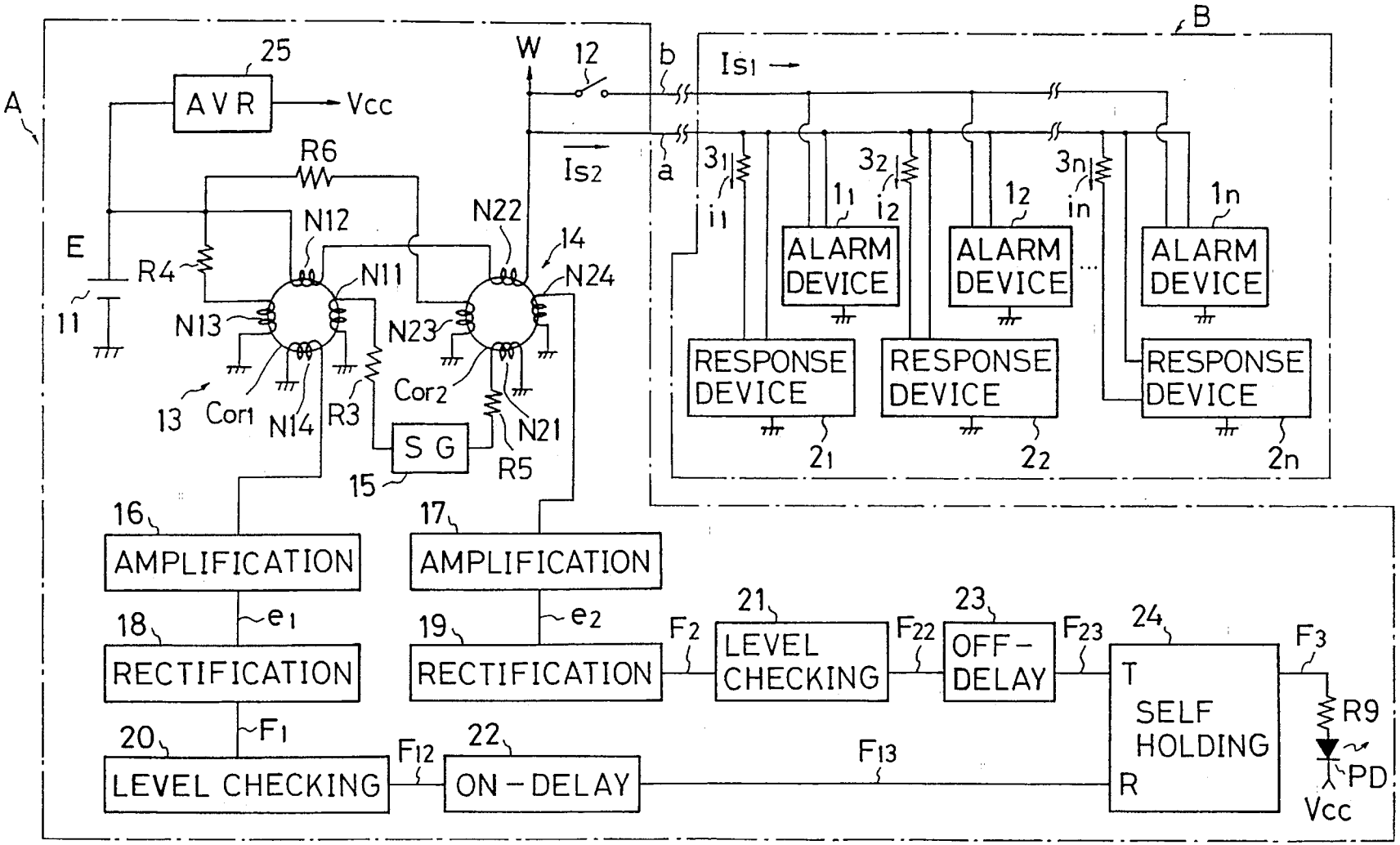
FIG. 1 is a block circuit diagram illustrating a first embodiment of a monitoring apparatus for an alarm device according to the present invention.

FIG. 1 shows the structure of a first embodiment of a monitoring apparatus for an alarm device according to the present invention.

In FIG. 1, symbol A indicates a drive side of the alarm device, while symbol B indicates an alarm device side, which is located for example at a work site where there are mechanical moving parts.

On the alarm device side B, there is provided a plurality of alarm devices $1_1$ through $1_n$ for generating an audible alarm, and a plurality of response devices $2_1$ through $2_n$ which act as audible alarm generation sensing devices for sensing the generation of audible alarms by the respective alarm devices $1_1$ through $1_n$, and respectively communicating this to the alarm device drive side A. A drive voltage E from a direct current power source 11 on the alarm device drive side A is applied through a feeder "a" to the respective alarm devices $1_1$ through $1_n$ and the respective response devices $2_1$ through $2_n$. Moreover, a command lead "b" having a drive switch 12 disposed therein on the alarm device drive side A for drive of the alarm devices, is connected in parallel with the feeder "a" to the respective alarm devices $1_1$ through $1_n$, the construction being such that by switching on the drive switch 12, a command signal for the generation of audible alarms is simultaneously applied to drive all of the alarm devices $1_1$ through $1_n$.

Current reducing resistors $3_1$ through $3_n$ for increasing the current in the feeder "a" due to the output signals when audible alarms are detected, are connected to the respective response devices $2_1$ through $2_n$. Predetermined respective currents $i_1$ through $i_n$ flow in the respective current reducing resistors $3_1$ through $3_n$ when the generation of an alarm in the respective alarm devices $1_1$ through $1_n$ is verified by the corresponding respective response devices $2_1$ through $2_n$.

Accordingly, when the drive switch 12 is switched ON, an audible alarm is generated normally from the alarm devices $1_1$ through $1_n$, and the respective response devices $2_1$ through $2_n$ operate normally to sense the audible alarm, the current flowing in the feeder "a" is the sum of the currents $i_1$ through $i_n$ flowing in the respective current reducing resistors $3_1$ through $3_n$, in addition to the sum of the drive currents of the alarm devices $1_1$ through $1_n$ and the drive currents of the response devices $2_1$ through $2_n$.

Figure 2:
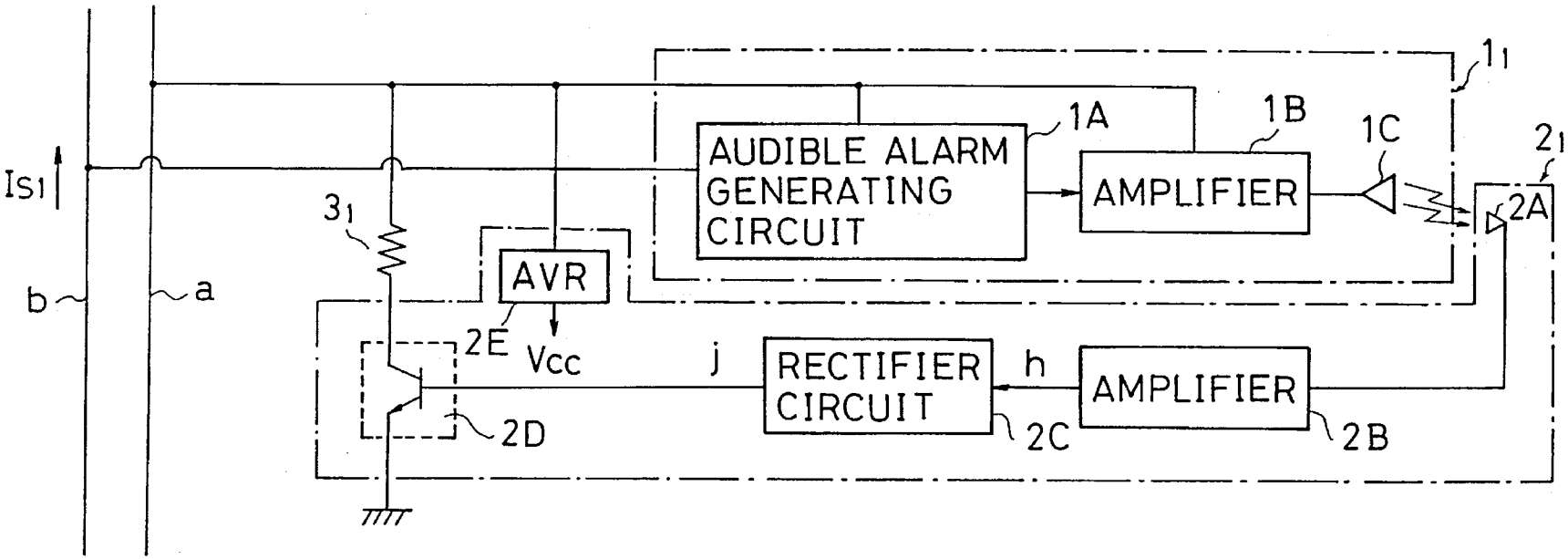
FIG. 2 is a block circuit diagram illustrating an alarm device and response device provided on an alarm device side.

FIG. 2 illustrates an embodiment of the alarm devices $1_1$ through $1_n$ and the response devices $2_1$ through $2_n$. Since the construction of each of the alarm devices $1_1$ through $1_n$, and each of the response devices $2_1$ through $2_n$ is similar, the following description is given for the alarm device $1_1$ and the response device $2_1$ only.

As shown in FIG. 2, the alarm device $1_1$ incorporates an audible alarm generating circuit 1A for generating an output to produce an audible alarm when a command signal is supplied from the command lead "b" (current $I_{s1}$ flows in command lead "b"), an amplifier 1B for amplifying the output from the audible alarm generating circuit 1A, and a speaker 1C for generating an audible alarm from the amplified output of the amplifier 1B. Drive voltage for the audible alarm generating circuit 1A and the amplifier 1B is supplied from the feeder "a".

The response device $2_1$ incorporates a microphone 2A (audio/electric converter) for receiving the audible alarm from the speaker 1C and generating an electrical output corresponding thereto, an amplifier 2B for amplifying the output signal from the microphone 2A, a rectifier circuit 2C for rectifying an output signal "h" from the amplifier 2B, a switching circuit 2D for being switched in accordance with an output signal "j" from the rectifier circuit 2C, and a constant voltage power supply 2E for keeping the drive voltage of the amplifier 2B, the rectifier circuit 2C, and the switching circuit 2D at a constant voltage Vcc. A similar constant voltage power supply may also be provided on the alarm device $1_1$ side.

Figure 3:
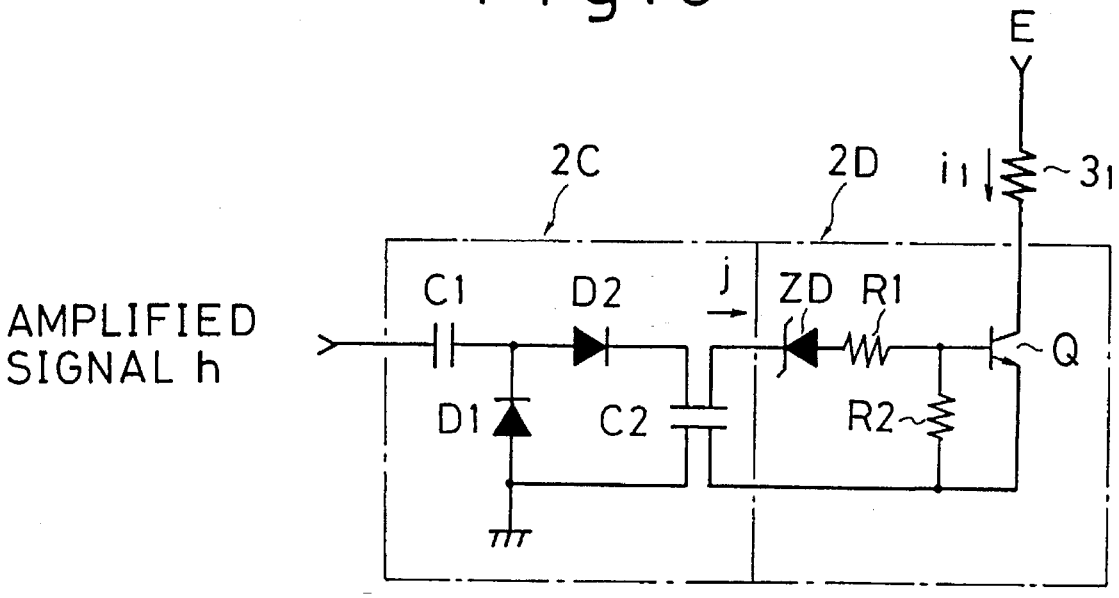
FIG. 3 is a circuit diagram of a rectifying circuit and switching circuit in the response device.

The rectifier circuit 2C and switching circuit 2D are constructed as shown in FIG. 3.

The rectifier circuit 2C is a voltage doubler rectifier circuit comprising capacitors C1, C2 and diodes D1, D2. The capacitor C2 which has a smoothing function, utilizes a four terminal capacitor such as disclosed in U.S. Pat. No. 5,027,114, to thereby ensure fail safety so that when a disconnection fault occurs in the lead thereof, the rectified output signal "j" is not transmitted to the latter switching circuit 2D.

The switching circuit 2D comprises a Zener diode ZD, resistors R1, R2, and a transistor Q. The Zener diode ZD is for imparting a threshold value to the output signal "j" of the rectifier circuit 2C, while the resistor R2 is for carrying the leakage current of the transistor Q. The beforementioned current reducing resistor $3_1$ is connected to the collector side of the transistor Q.

Figure 4:
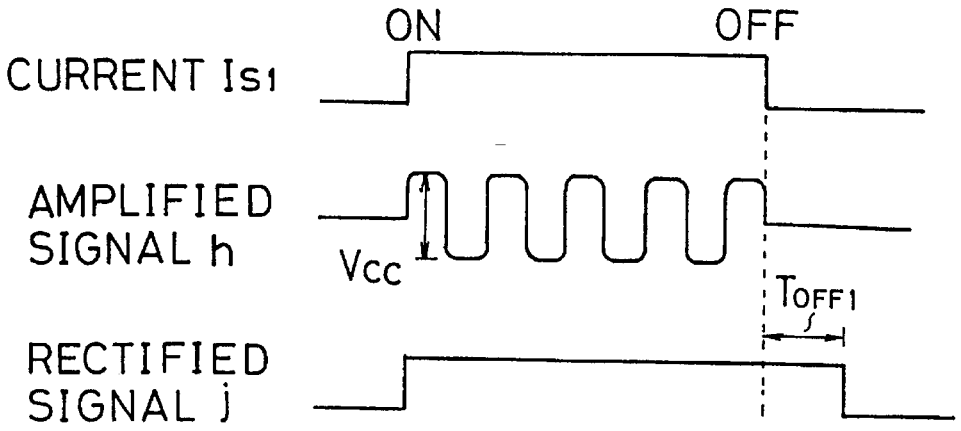
FIG. 4 is a time chart illustrating output conditions of the response device at the time of receiving an audible alarm.

With the response device $2_1$ constructed in this manner, then as shown in FIG. 4, when the drive switch 12 is switched ON so that a current $I_{s1}$ (command signal) flows in the command lead "b" and an audible alarm issues from the alarm device $1_1$, this audible alarm is reproduced in the microphone 2A as an electrical signal which is then amplified in the amplifier 2B and input to the rectifier circuit 2C. When the electrical signal from the microphone 2A is large, the amplified alternating current output signal "h" from the amplifier 2B is saturated as shown in FIG. 4 and is input to the rectifier circuit 2C where it is rectified and then fed to the switching circuit 2D. Here the electrostatic capacity of the capacitor C2 of the rectifier circuit 2C is set relatively large, so that, as shown in FIG. 4, even after switching off the drive switch 12 (stopping the current $I_{s1}$) and stopping the audible alarm, the rectified output signal "j" does not immediately cease but continues on for a predetermined fall delay time $T_{OFF1}$. The rectifier circuit 2C thus has an off-delay function.

The rectified output signal "j" is input through the Zener diode ZD and the resistor R1 to the base of the-transistor Q in the switching circuit 2D, so that the transistor Q conducts. The transistor Q of the switching circuit 2D thus comes ON, allowing the current $i_1$ to flow in the resistor $3_1$, causing a change in the current flowing in the feeder "a", and thus indicating on the alarm device drive side B, via the feeder "a", that an audible alarm has issued from the alarm device $1_1$. This current change in the feeder "a" is equivalent to the audible alarm sensed output.

Next is a detailed description of the structure of the alarm device drive side A.

As shown in FIG. 1, a first current sensor 14 and a second current sensor 13 are arranged along the feeder "a" connecting the direct current power source 11 with the alarm devices $1_1$ through $1_n$ and the response devices $2_1$ through $2_n$.

The second current sensor 13 comprises four windings namely first through fourth windings N11 through N14, and a saturable magnetic core $Cor_1$ made for example from a ring shaped amorphous magnetic material, about which is wound the first through fourth windings N11 through N14. The first winding N11 is connected through a resistor R3 to a signal generator 15 which produces a high frequency signal. The second winding N12 is connected on one side to the direct current power source 11, and on the other side through a second winding N22 of the first current sensor 14 to be described later, to the feeder "a" and the command lead "b". A voltage from the direct current power source 11 is applied through a resistor R4 to the third winding N13. The sensor output is produced from the fourth winding N14.

The first current sensor 14 also, as with the second current sensor 13, comprises four windings namely first through fourth windings N21 through N24, and a saturable magnetic core $Cor_2$ made for example from a ring shaped amorphous magnetic material, about which is wound the first through fourth windings N21 through N24. The first winding N21 is connected through a resistor R5 to the signal generator 15. The second winding N22 is connected on one side through the second winding N12 of the second current sensor 13, to the direct current power source 11, and on the other side to the feeder "a" and the command lead "b". A voltage from the direct current power source 11 is applied through a resistor R6 to the third winding N23. The sensor output is produced from the fourth winding N24.

The construction of the second current sensor 13 is such that a current is supplied to the third winding N13, of a magnitude and direction to create a magnetic flux which cancels a magnetic flux produced in the saturable magnetic core Con when the current $I_{s2}$ flowing in the feeder "a" at the time of no flow of response signal currents $i_1$ through $i_n$ for any of the response devices $2_1$ through $2_n$ when the drive switch 12 is OFF, flows in the second winding N12. Accordingly, since the saturable magnetic core $Cor_1$ is not saturated when the abovementioned current is flowing in the second winding N12, the high frequency signal supplied to the first winding N11 is transmitted to the fourth winding N14 so that the second current sensor 13 gives a high level output by way of the fourth winding N14. If the drive switch 12 is ON so that a current $I_{s1}$ flows in the command lead "b", or if there is a flow of even one of the response signal currents $i_1$ through $i_n$, then the current flowing in the second winding N12 changes and the saturable magnetic core $Cor_1$ becomes saturated. Hence the high frequency signal supplied to the first winding N11 is not transmitted to the fourth winding N14, and the second current sensor 13 gives a low level output.

That is to say, the second current sensor 13 gives a high level output only when the alarm devices $1_1$ through $1_n$ are in a non drive condition (drive switch 12 is OFF) and there is no output from any of the response devices $2_1$ through $2_n$ so that a current does not flow in the current reducing resistors $3_1$ through $3_n$. However, during drive of the alarm devices $1_1$ through $1_n$ (drive switch 12 is ON), or when a fault occurs such as a conduction fault between the collector/emitter of the transistor Q in even one of the response devices $2_1$ through $2_n$, so that a response signal current flows, a high level output is not produced.

With the first current sensor 14, a current is supplied to the third winding N23, of a magnitude and direction to create a magnetic flux which cancels a magnetic flux produced in the saturable magnetic core $Cor_2$ when the current during the period (the fall delay time $T_{OFF1}$) when all of the response signal currents $i_1$ through $i_n$ of the response devices $2_1$ through $2_n$ flow in the feeder "a" after switching off the drive switch 12 to terminate the audible alarms from the alarm devices $1_1$ through $1_n$ of the alarm device side B, flows in the second winding N22.

Accordingly, since the saturable magnetic core $Cor_2$ is not saturated when the abovementioned current is flowing in the second winding N22, then the high frequency signal supplied to the first winding N21 is transmitted to the fourth winding N24 so that the first current sensor 14 gives a high level output. If the drive switch 12 is ON so that a current $I_{s1}$ flows in the command lead "b" and a speaker drive current flows in the feeder "a", or if even one of the response signal currents $i_1$ through $i_n$ does not flow, then the saturable magnetic core $Cor_2$ becomes saturated. Hence the high frequency signal supplied to the first winding N21 is not transmitted to the fourth winding N24, and the first current sensor 14 gives a low level output.

That is to say, the first current sensor 14 gives a high level output only while all of the response signal currents are still flowing after the audible alarm of the alarm devices $1_1$ through $1_n$ has been terminated. When the alarm devices $1_1$ through $1_n$ are being driven, or when they are in a non drive condition with no output from the response devices $2_1$ through $2_n$ (at this time the current flowing in the second winding N22 is less than that flowing in the third winding N23) a high level output is not produced.

The output signals from the respective second and first current sensors 13, 14 are input to respective amplifiers 16, 17, where they are amplified and output as amplified output signals e1, e2. The signals e1, e2 are then input to respective rectifier circuits 18, 19 and rectified.

Figure 5:
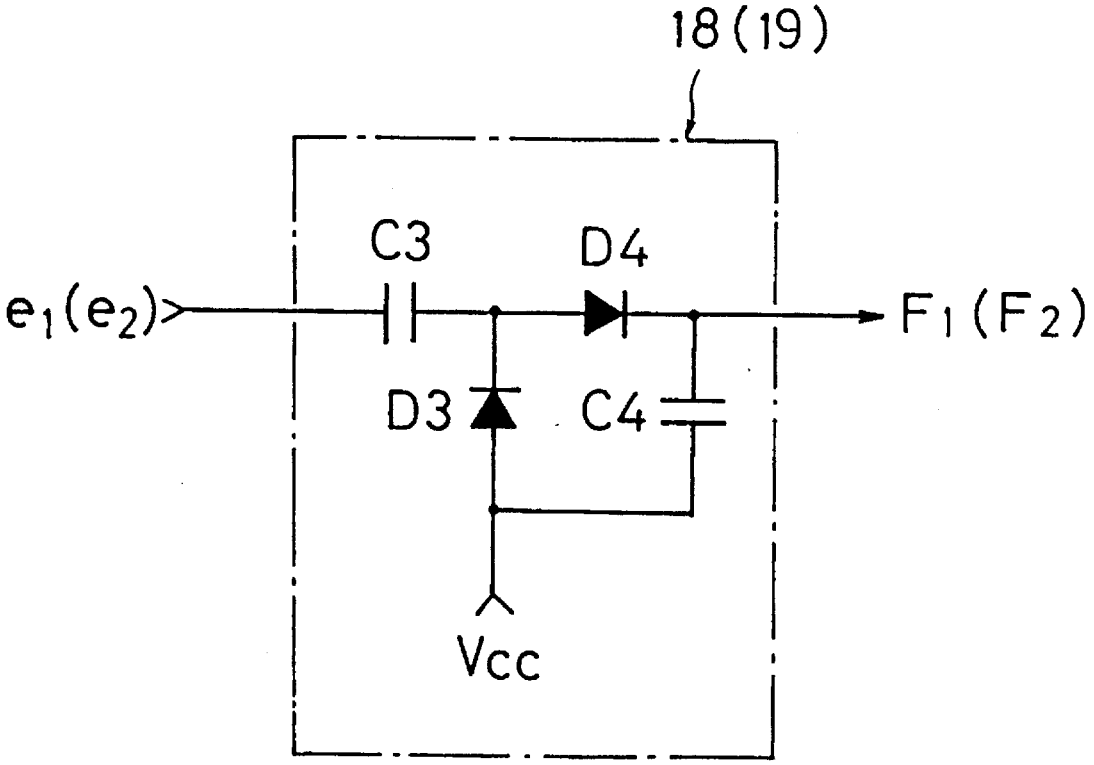
FIG. 5 is a circuit diagram of a rectifying circuit provided on an alarm device drive side.

The rectifier circuits 18, 19 have a similar construction. More specifically, as shown in FIG. 5, they comprise voltage doubler rectifying circuits having two capacitors C3, C4 and two diodes D3, D4, with rectified output signals F1, F2 each clamped at the power source voltage Vcc.

Respective level checking circuits 20, 21 (see FIG. 1) have respective threshold values $V_{t1}$, $V_{t2}$. When the rectified output signals F1, F2 input from the corresponding rectifier circuits 18, 19 have a higher level than the respective threshold values $V_{t1}$, $V_{t2}$, they are oscillated to produce respective alternating current output signals F12, F22. On the other hand, when the rectified output signals F1, F2 have a lower level than the respective threshold values $V_{t1}$, $V_{t2}$, an oscillating output is not generated.

Figure 6:
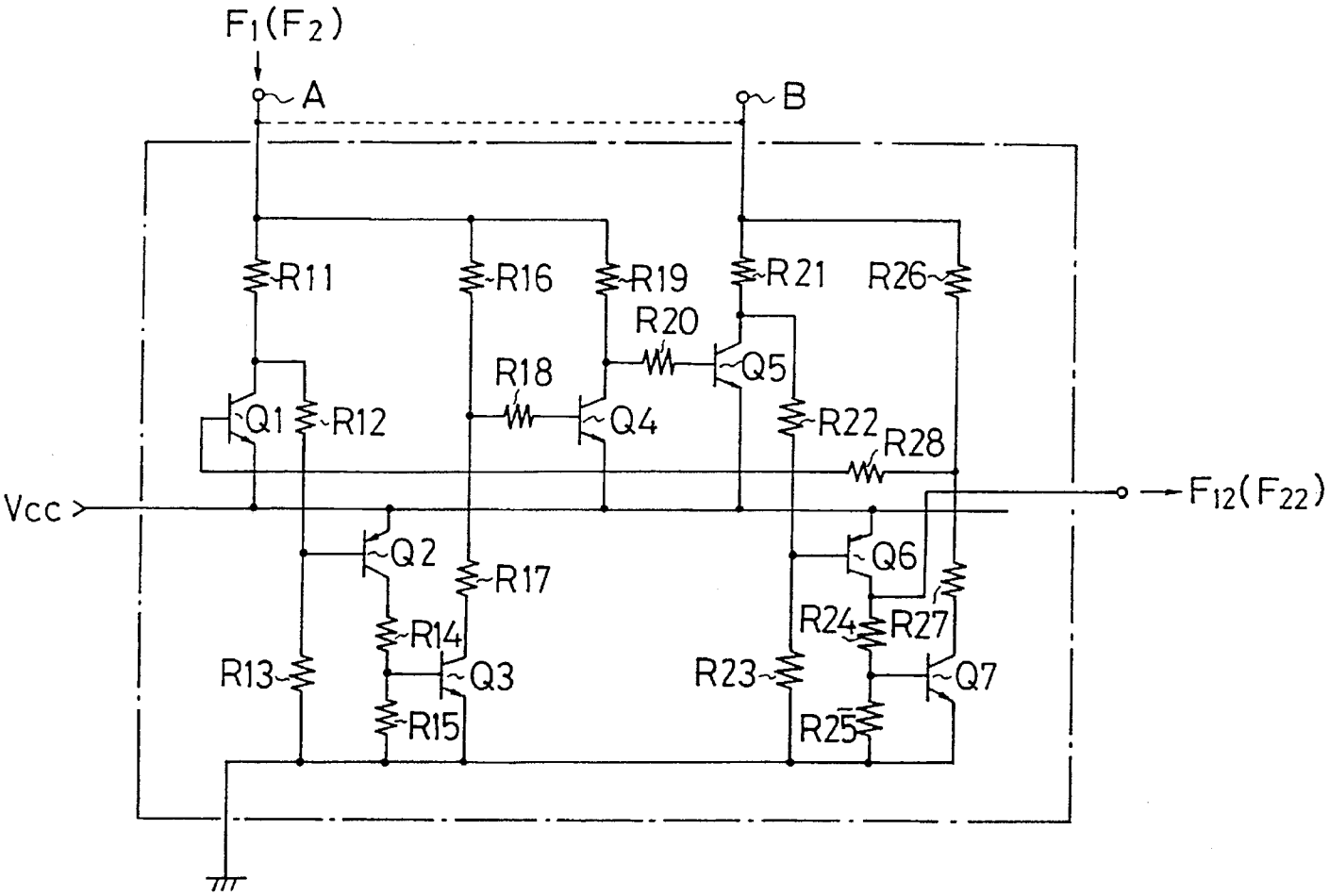
FIG. 6 is a circuit diagram of a level checking circuit.

The level checking circuits 20, 21 have a similar construction. More specifically, each one of the circuit comprises a fail safe window comparator having a circuit structure such as shown in FIG. 6. Such a fail safe window comparator is disclosed for example in U.S. Pat. No. 5,027,114 or U.S. Pat. No. 4,661,880.

The window comparator of FIG. 6, comprises for example, resistors R11 through R28 and transistors Q1 through Q7. Respective input terminals A, B have upper and lower limit threshold values, so that when a signal of an input level within the range of the respective threshold values is input to the input terminals A, B, an oscillating alternating current output signal is generated at high frequency.

That is to say, the construction is such that oscillation only occurs when the respective inputs satisfy the following conditions:

$$\frac{(R11+R12+R13)Vcc}{R13} < V1 < \frac{(R16+R17)Vcc}{R17} \quad (1)$$

$$\frac{(R21+R22+R23)Vcc}{R23} < V2 < \frac{(R26+R27)Vcc}{R27} \quad (1)$$

where $V_1$, $V_2$ are the respective input voltages on the input terminals A, B, and Vcc is the power source voltage.

The respective level checking circuits 20, 21 of the present embodiment are constructed with the window comparator input terminals A, B of FIG. 6 made common as shown by the dotted line in FIG. 6, and the rectified output signals F1, F2 from the corresponding rectifier circuits 18, 19 are input to the input terminal A. The threshold values $V_{t1}$, $V_{t2}$ are set in accordance with conditions of the above equations (1), (2). The fail safe window comparator as disclosed for example in U.S. Pat. No. 5,027,114 or U.S. Pat. No. 4,661,880, has an upper limit threshold value. However, with the present embodiment, the upper limit threshold value is set to a sufficiently high value compared to the input level, and does not participate to the level checking computation.

An on-delay circuit 22 which takes the output signal F12 from the level checking circuit 20, is constructed so as to rectify the alternating current output signal F12 from the level checking circuit 20, and the rectified output signal F13' (see FIG. 7) is then output with a rise delay time TON.

Figure 7:
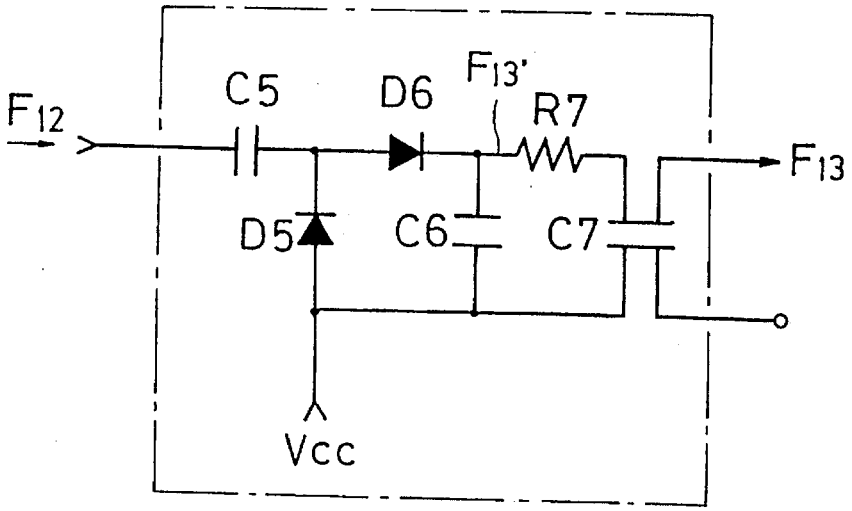
FIG. 7 is a circuit diagram of an on-delay circuit.

More specifically, as shown in FIG. 7, the on-delay circuit 22 comprises three capacitors C5, C6, C7, two diodes D5, D6, and a resistor R7. The alternating current output signal F12 from the level checking circuit 20 is voltage doubler rectified by the capacitors C5, C6 and the diodes D5, D6. The rectified output signal F13' which is clamped at the power source voltage Vcc, is then output to the next step as an output signal F13 having a rise delay time $T_{ON}$ determined by the time constant of the resistor R7 and the four terminal capacitor C7.

An off-delay circuit 23 which takes the output signal F22 from the level checking circuit 21, is constructed so as to rectify the alternating current output signal F22 from the level checking circuit 21, and delay the rectified output by a predetermined fall delay time $T_{OFF2}$.

Figure 8:
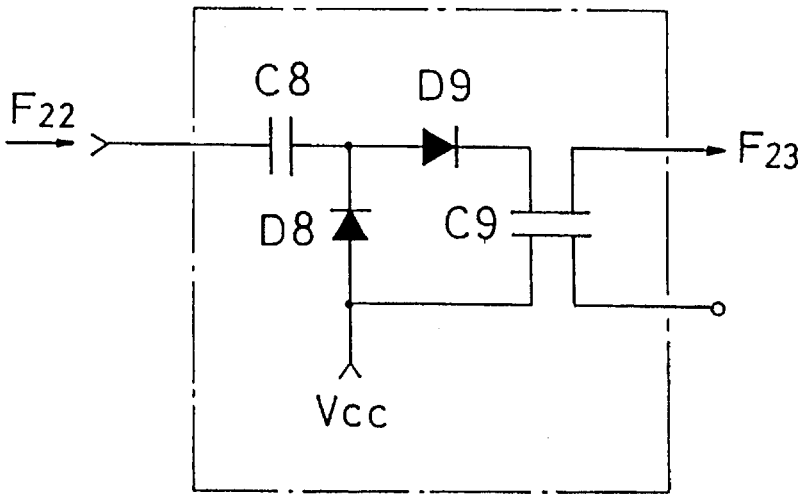
FIG. 8 is a circuit diagram of an off-delay circuit.

More specifically, as shown in FIG. 8 the off-delay circuit 23 has a construction similar to a simplified construction of the rectifier circuit 2C shown in FIG. 3, with the alternating current output signal F22 voltage doubler rectified by two capacitors C8, C9 and two diodes D8, D9, and the rectified output signal output to the next step as an output signal F23, having a fall delay time $T_{OFF2}$ due to the electrostatic capacity of the four terminal capacitor C9 being set large. The construction of the off-delay circuit 23 however differs from that of the rectifier circuit 2C shown in FIG. 3 in that the rectified output signal is clamped at the power source voltage Vcc as with the on-delay circuit 22 of FIG. 7.

The first verification device for verifying the generation of a sensed output for audible alarm generation for a predetermined time after turning off the drive switch 12, comprises the first current sensor 14, the amplifier 17, the rectifier circuit 19, the level checking circuit 21 and the off-delay circuit 23. Moreover, the second verification device for verifying that the alarm device side has normally returned to the original condition after generation of the audible alarm, comprises the second current sensor 13, the amplifier 16, the rectifier circuit 18, the level checking circuit 20 and the on-delay circuit 22.

The respective output signals F13, F23 of the on-delay circuit 22 and off-delay circuit 23 are respectively input to a fail-safe self-holding circuit 24 which acts as a judgement device.

The self-holding circuit 24 is constructed such that when a terminal R which takes the output signal F13 of the on-delay circuit 22 is the reset input terminal, and a terminal T which takes the output signal F23 of the off-delay circuit 23 is the trigger input terminal, and both input levels of the signals input to the input terminals T, R are high, an output is generated and fed back to the trigger input terminal T to thus self-hold the output.

Figure 9:
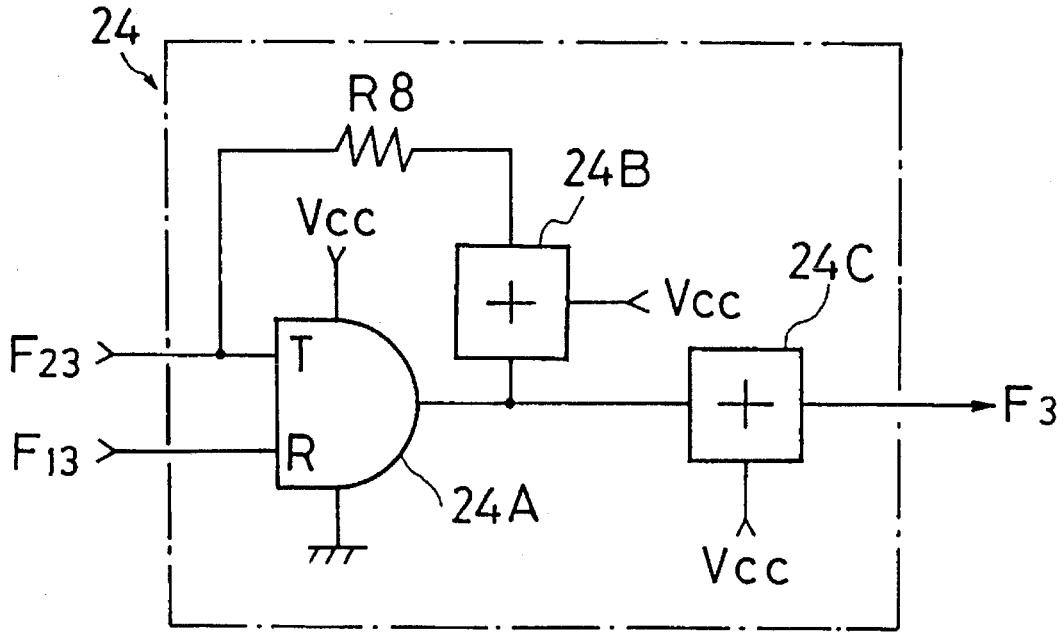
FIG. 9 is a circuit diagram of a self-holding circuit.

More specifically, as shown in FIG. 9, the self-holding circuit 24 comprises a two input fail safe AND gate 24A, a rectifying circuit 24B for rectifying the alternating current oscillating output of the AND gate 24A and feeding back the rectified output through a resistor R8 to the trigger input terminal T side, and a rectifying circuit 24C for rectifying the alternating current oscillating output of the AND gate 24A and producing a rectified output as a self-holding circuit output signal F3. When a high level signal is input to the trigger input terminal T and the reset input terminal R, an alternating current oscillating output is produced from the AND gate 24A, and fed back through the rectifying circuit 24B and the resistor R8 to the trigger input terminal T. The oscillating output of the AND gate 24A is thus self-held and the rectified output from the rectifying circuit 24C continues to be generated as the self-holding circuit output signal F3, until the input signal of the reset input terminal R becomes a predetermined low level.

The AND gate 24A uses the window comparator shown in FIG. 6 as an AND gate by setting the upper limit threshold value sufficiently large as disclosed for example in the beforementioned U.S. Pat. No. 4,661,880. Both rectifying circuits 24B, 24C are voltage doubler rectifying circuits with a construction similar to that shown in FIG. 5. The fail-safe self-holding circuit 24 is disclosed for example in beforementioned U.S. Pat. No. 5,027,114 or U.S. Pat. No. 4,667,184.

A light-emitting diode PD is connected through a resistor R9 to the output terminal of the self-holding circuit 24. When the output signal F3 is a high level (a level higher than the power source voltage Vcc, corresponding to a logic value "1"), the light-emitting diode PD comes on, thus enabling verification that all of the alarm devices $\mathbf{1}_1$ through $\mathbf{1}_n$ have operated normally and the audible alarms sounded, and the alarm device side B has then normally returned to the original condition.

A drive voltage Vcc is supplied by means of a constant voltage power supply 25 to the abovementioned respective amplifiers 16, 17, rectifier circuits 18, 19, level checking circuits 20, 21, on-delay circuit 22, off delay circuit 23 and self-holding circuit 24.

Figure 10:
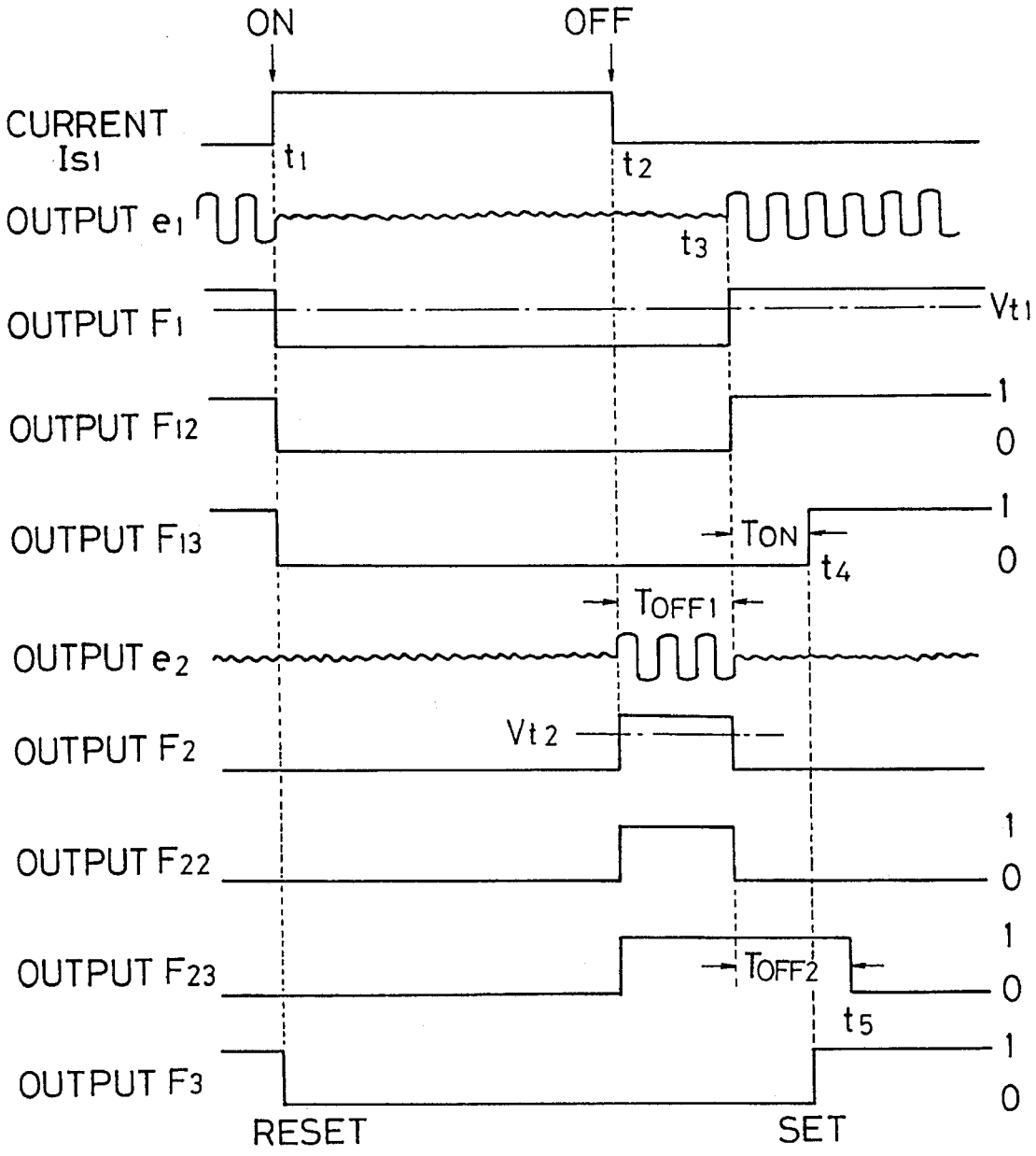
FIG. 10 is a time chart illustrating an audible alarm monitoring operation of the apparatus of the first embodiment.

As follows is a description of an alarm monitoring operation of the apparatus of the present embodiment with reference to the time chart of FIG. 10.

To warn the operator of the start-up of a mechanical moving part, the drive switch 12 in the alarm device drive side A is switched on (time $t_1$) to supply the current Is1 to the command lead "b" so that all of the alarm devices $\mathbf{1}_1$ through $\mathbf{1}_n$ operate and audible alarms are generated simultaneously from the alarm devices $\mathbf{1}_1$ through $\mathbf{1}_n$. The alarm sounds are received by the corresponding response devices $\mathbf{2}_1$ through $\mathbf{2}_n$ so that respective response signal currents $i_1$ through $i_n$ flow in the respective current reducing resistors $\mathbf{3}_1$ through $\mathbf{3}_n$. In this situation, both of the saturable magnetic cores $Cor_1$, $Cor_2$ of the current sensors 13, 14 become saturated, so that the output levels from the two current sensors 13, 14 both become a low level. The respective amplified output signals e1, e2 are therefore a low level so that the input to the reset input terminal R of the self-holding circuit 24 becomes a low level (corresponding to logic value "0"). The self-holding circuit 24 is thus reset, and the output signal F3 stopped (logic value "0").

When at time $t_2$ the drive switch 12 is switched off, the generation of audible alarms from the alarm devices $\mathbf{1}_1$ through $\mathbf{1}_n$ is stopped. However the response signal currents $i_1$ through $i_n$ continue to flow in the respective current reducing resistors $\mathbf{3}_1$ through $\mathbf{3}_n$ due to the off-delay function of the rectifier circuits 2C in the respective response devices $\mathbf{2}_1$ through $\mathbf{2}_n$. As a result, the amplified output signal e1 based on the output of the second current sensor 13 remains at the low level. However, the amplified output signal e2 based on the output of the first current sensor 14 becomes a high level. This high level amplified output signal e2 is generated after switching off the drive switch 12, during the time that all of the response signal currents $i_1$ through $i_n$ continue to be generated based on the fall delay time $T_{OFF1}$ of the rectifier circuits 2C in the respective response devices $\mathbf{2}_1$ through $\mathbf{2}_n$.

The amplified output signal $e_2$ is rectified in the rectifier circuit 19. The rectified output signal F2 is then compared with the threshold value $V_{t2}$ of the level checking circuit 21 and wave formed thereby to give an output signal $F_{22}$ such as shown in FIG. 10. The output signal $F_{22}$ is input to the off-delay circuit 23, where it is delayed by a predetermined fall delay time $T_{OFF2}$, before falling to a low level at time $t_5$.

On the other hand, when the drive switch 12 is turned off, and after a time $t_3$ when all of the response signal currents $i_1$ through $i_n$ stop flowing, conditions return to those before switching on the drive switch 12 wherein the response signal currents $i_1$ through $i_n$ do not flow, and the amplified output signal $e_1$, based on the second current sensor 13 becomes a high level. This amplified output signal e1 is rectified in the rectifier circuit 18. The rectified output signal F1 is then compared with the threshold value $V_{t1}$ of the level checking circuit 20 and wave formed thereby to give an output signal $F_{12}$ such as shown in FIG. 10. The output signal F12 is input to the on-delay circuit 22, where it is delayed by a predetermined rise delay time $T_{ON}$, before rising to a high level at time $t_4$.

In this way, when all functions are operating normally, since prior to the fall in the output signal F23 of the off-delay circuit 23, which is input to the trigger input terminal T of the self-holding circuit 24, the high level output signal F13 from the on-delay circuit 22 is input to the reset input terminal R, the output signal F3 from the self-holding circuit 24 is self-held and maintained at a high level condition (higher than power source voltage Vcc). This is then applied through the resistor R9 to the light-emitting diode PD so that a voltage higher than the power source voltage Vcc is supplied, causing the light-emitting diode PD to emit light. This indicates that all of the audible alarms have sounded and conditions have normally returned to the original condition. Accordingly, once the lighting of the light-emitting diode PD is verified, the mechanical moving parts can be activated safely.

In the event that an audible alarm signal is not produced from one of the alarm devices $\mathbf{1}_1$ through $\mathbf{1}_n$, then one of the response signal currents $i_1$ through $i_n$ will not flow in the response devices $\mathbf{2}_1$ through $\mathbf{2}_n$, so that the saturable magnetic core $Cor_2$ of the first current sensor 14 will be saturated and the sensor output becomes a low level. If the input level at the trigger input terminal T of the self-holding circuit 24 is not a high level, the self-holding circuit 24 does not trigger and the light-emitting diode PD does not emit light. Hence it can be known that an audible alarm has not been produced by one of the alarm devices.

As follows is a description of the fail-safe features of the apparatus of the present embodiment shown in FIG. 1.

When a failure of the switching circuits 2D occurs in at least one of the response devices $\mathbf{2}_1$ through $\mathbf{2}_n$ so that a response signal current continues to flow, the saturable magnetic core $Cor_1$ of the second current sensor 13 is saturated so that the sensor output does not become a high level. The self-holding circuit 24 therefore does not self-hold and the light-emitting diode PD does not emit light.

Moreover, when a disconnection fault occurs in one or other of the second winding N12 and the third winding N13 of the second current sensor 13, or similarly when a disconnection fault occurs in one or other of the second winding N22 and the third winding N23 of the first current sensor 14, then the respective saturable magnetic core $Cor_1$, $Cor_2$ becomes saturated and the output of the respective current sensors 13, 14 becomes a low level. Also, when a disconnection fault occurs in the respective resistors R4, R6 connected to the third windings N13, N23 of the respective current sensors 13, 14, a similar phenomena occurs. When a disconnection fault occurs in the first windings N11, N21, or the fourth windings N14, N24, there is no output from the respective current sensors 13, 14.

Now when a disconnection fault occurs in both of the second windings N12, N22 and the third windings N13, N23 of the respective current sensors 13, 14, a high frequency signal of the signal generator 15 is transmitted directly from the first winding N11 to the fourth winding N14 of the second current sensor 13, and from the first winding N21 to the fourth winding N24 of the first current sensor 14, so that the respective first and second current sensors 13, 14 give a high level output. If faults of this level are to be considered, the construction shown in FIG. 11 may be applied.

Figure 11:
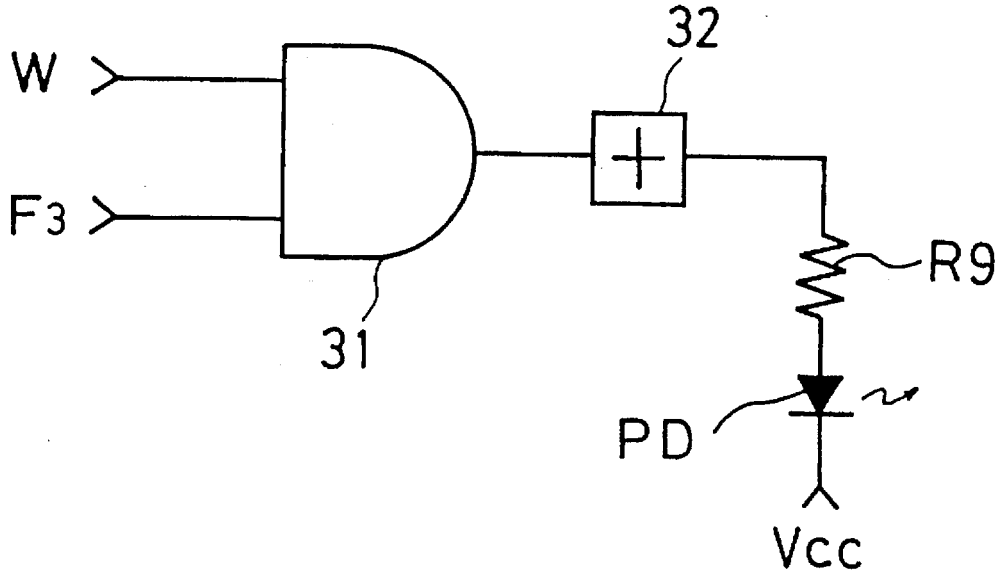
FIG. 11 is a block circuit diagram of the main parts of a second embodiment of the present invention.

FIG. 11 shows the structure of the main parts of another embodiment whereby fail-safe features can be maintained even in the event of the first winding and second winding in the respective current sensors becoming disconnected at the same time.

With this embodiment there is provided a fail safe AND gate 31 with the upper limit threshold value of the window comparator of the construction of FIG. 6 set sufficiently high, provided between the self-holding circuit 24 and the resistor R9 of FIG. 1, and a rectifier circuit 32 comprising a voltage doubler rectifier circuit of the circuit structure shown in FIG. 5 for rectifying an oscillating alternating current output of the AND gate 31. The output signal F3 from the self-holding circuit 24 is input to one of the input terminals of the fail safe AND gate 31, while a signal W from the output side of the second winding N22 of the first current sensor 14 is input to the other terminal.

With this construction, the signal W has a high level condition when the respective second windings N12, N22 of the respective first and second current sensors 13, 14 are in a normal condition. If at this time a high level output from the self-holding circuit 24, verifying normal operation of the alarm device side B, is input, then the two AND gate inputs both become high level, giving a high level output from the AND gate 31 so that the light-emitting diode PD comes on. On the other hand, when a disconnection fault occurs in the respective second windings N12, N22 of the first and second current sensors 13, 14, the signal W input to the other input terminal of the AND gate 31 is lost, so that the AND gate 31 output becomes a low level and the light-emitting diode PD does not light. Here the AND gate 31 carries out a logical product operation on the signal W and the signal F3.

Concerning the amplifiers 16, 17, these amplify by alternating current coupling which does not involve negative feedback, however do not produce an alternating current output signal by themselves at the time of a fault. Moreover, with the rectifier circuits 18, 19, the level checking circuits 20, 21, the on-delay circuit 22, the off-delay circuit 23, and the self-holding circuit 24, since the construction is such that an output signal higher than the power source voltage Vcc is not generated at the time of a fault, then in the event of a fault in any of these, a high level output signal (higher than the power source voltage $V_{cc}$) is not generated by the self-holding circuit 24.

Furthermore, since the four terminal capacitor as shown in FIG. 3 is used in the smoothing capacitors of the respective rectifier circuits of the response devices $\mathbf{2}_1$ through $\mathbf{2}_n$, then in the event of a disconnection fault at the electrodes of the capacitors, the alternating current output signal from the amplifier in the previous step is not output directly from the response devices $\mathbf{2}_1$ through $\mathbf{2}_n$ (the alternating current signal is not output as an output signal of the current sensor).

With the apparatus of the present embodiments as described above, the generation of an audible alarm from all of the alarm devices $1_1$ through $1_n$ can be verified at the alarm device drive side A which is located remotely from the alarm device side B. Moreover, it can be verified that the alarm device side B has normally returned to the original condition. Furthermore, since a verification signal for audible alarm generation can be sent to the alarm device drive side A using the feeder "a" for supplying power from the alarm device drive side A to the alarm device side B, there is no need for the provision of separate wiring for the transmission of a signal for verification of audible alarm generation to the alarm device drive side A. Moreover, the apparatus is a fail safe monitoring apparatus which ensures there is no accidental audible alarm verification output. Accordingly, the safety of an operator at a work site such as a factory can be ensured.

The present embodiment has been described for the case of a plurality of alarm devices and response devices. However, needless to say it is also applicable to the case of only one alarm device and response device.

INDUSTRIAL APPLICABILITY

The present invention enables verification in the case where an alarm drive is carried out remotely from an alarm device, that an audible alarm for warning an operator of a danger, has been reliably generated. It therefore has wide industrial applicability in ensuring the safety of personnel working at factories and the like.

We claim:

1. A monitoring apparatus for an alarm device, where an alarm device side is situated remotely from an alarm device drive side, for monitoring from the alarm device drive side, the generation of an audible alarm at the alarm device side, said alarm device side including; an alarm device for generating an audible alarm, and an audible alarm generation sensing means for sensing an audible alarm generated by said alarm device and transmitting an audible alarm sensed output to said alarm device drive side within a predetermined time interval after the audible alarm has stopped, said alarm device drive side including; a power source connected through a feeder to said alarm device and audible alarm generation sensing means on the alarm device side, a drive switch disposed in a command lead connected in parallel with said feeder connecting the power source and alarm device, which is switched on to apply a command signal for audible alarm generation to said alarm device, first verification means for verifying the generation of an audible alarm based on an audible alarm sensed output from said audible alarm generation sensing means transmitted through said feeder after audible alarm generation of said alarm device is stopped by switching off said drive switch, second verification means for verifying that the alarm device side has returned to an original condition the same as that prior to audible alarm generation, based on a current change in said feeder due to the stopping of the audible alarm sensed output of the audible alarm generation sensing means, and judgement means for generating a normal judgement output indicating that an audible alarm has been generated normally, when a verification output of an audible alarm sensed output is generated in the first verification means, and a verification output of the return to the original condition is generated in the second verification means.

2. A monitoring apparatus for an alarm device according to claim 1, wherein said audible alarm generation sensing means incorporates, an audio/electric converter for receiving an audible alarm from the alarm device and giving an electrical output corresponding thereto, an amplifier for amplifying the output from the audio/electric converter, a rectifier circuit for rectifying an output from the amplifier and provided with an off-delay function which delays a fall in the rectified output by a predetermined time, a switching circuit having a transistor with a collector connected through a current reducing resistor to said feeder, and an emitter connected to earth, and which comes on when an output from said rectifier circuit is applied to the base, allowing a current to flow in said current reducing resistor thus changing the current in said feeder.

3. A monitoring apparatus for an alarm device according to claim 2, wherein said first verification means includes, a first current sensor which generates a high level verification output verifying audible alarm generation, only when a current is detected flowing in the feeder during the time a current is flowing in said current reducing resistor after switching off said drive switch, and an off-delay circuit which delays the fall in the output from the first current sensor by a predetermined time, said second verification means includes, a second current sensor which generates a high level verification output verifying that the alarm device side has returned to the original condition, only when a current is detected flowing in the feeder when the drive switch is switched off and there is no current flowing in said current reducing resistor, and said judgement means includes a self-holding circuit with the output of the off-delay circuit input as the trigger input, and the output of the second current sensor input as the reset input, for self-holding said trigger input.

4. A monitoring apparatus for an alarm device according to claim 3, wherein said first and second current sensors incorporate respective cores made from a saturable magnetic material, each with four windings namely first through fourth windings wound therearound, and arranged such that the respective first windings are supplied with a high frequency signal from a signal generator, the respective second windings are connected in series with each other along said feeder, the respective third windings are connected in parallel with each other to said power source, and the sensor outputs are produced from the respective fourth windings, the construction being such that a current is supplied to the third winding of the first current sensor to cancel a magnetic flux produced in the core thereof when the feeder current during the time a current is flowing in said current reducing resistor after switching off the drive switch, flows in the second winding of the first current sensor; and a current is supplied to the third winding of the second current sensor to cancel the magnetic flux produced in the core thereof when the feeder current at the time of no current flow in said current reducing resistor with the drive switch switched off, flows in the second winding of the second current sensor.

5. A monitoring apparatus for an alarm device according to claim 4, wherein said first verification means incorporates, an amplifier for amplifying a high frequency signal which is output from the fourth winding of the first current sensor, a rectifier circuit for rectifying the amplified output of the amplifier and clamping this at the power supply voltage, and a level checking circuit for generating a high level output when the output of the rectifier circuit is equal to or greater than a predetermined threshold value set higher than the power supply voltage, and is constructed such that a fall in the output of said level checking circuit is delayed by a predetermined time by said off-delay circuit.

6. A monitoring apparatus for an alarm device according to claim 4, wherein said second verification means has a construction incorporating; an amplifier for amplifying a high frequency signal output from the fourth winding of the second current sensor, a rectifier circuit for rectifying the amplified output of the amplifier and clamping this at the power supply voltage, a level checking circuit for generating a high level output when the output of the rectifier circuit is equal to or greater than a predetermined threshold value set higher than the power supply voltage, and an on-delay circuit which outputs the output of said level checking circuit after a predetermined time delay.

7. A monitoring apparatus for an alarm device according to claim 4, wherein the construction is such that when the second winding of the first current sensor and the second winding of the second current sensor are connected in series with each other along said feeder, a fail-safe type AND gate is provided which carries out a logical product operation on an output of the series circuit of the two second windings and an output of the judgement means, and generates no output at the time of a fault.

8. A monitoring apparatus for an alarm device according to claim 1, wherein the construction is such that a plurality of alarm devices and a plurality of audible alarm generation sensing means for respectively sensing the audible alarms of each alarm device are connected in parallel with each other to the feeder, and said plurality of alarm devices are also connected in parallel with each other to said command lead.

* * * * *